US006009929A

United States Patent [19]

Linderman et al.

[11] Patent Number: 6,009,929

[45] Date of Patent: Jan. 4, 2000

[54] EXTERIOR SKYLIGHT SOLAR SCREEN COVER

[76] Inventors: Tim Linderman; Jon Benson, both of 7514 Harpers Glen La., Houston, Tex. 77072

[21] Appl. No.: 08/988,879

[22] Filed: Dec. 11, 1997

[51] Int. Cl.[7] ..... A47H 1/00

[52] U.S. Cl. ..... 160/104; 160/369; 160/371; 454/94; 52/202; 52/211; 49/50

[58] Field of Search ..... 160/90, 104, 369, 160/371, 380, 37; 292/285, 113, 135, DIG. 5, DIG. 11; 49/276, 463, 323; 454/94, 95; 52/202, 106, 641

[56] References Cited

U.S. PATENT DOCUMENTS

| | | | |
|---|---|---|---|
| 1,778,261 | 10/1930 | Krueger . | |
| 2,092,673 | 9/1937 | Kempf | 160/104 |
| 2,466,948 | 4/1949 | Hemphill | 160/104 |
| 2,755,524 | 7/1956 | Honer | 160/104 |
| 2,962,137 | 11/1960 | Milavec | 160/104 |
| 3,800,687 | 4/1974 | Nozawa | 98/42 |
| 3,830,146 | 8/1974 | Kaiser | 98/41 SV |
| 4,691,958 | 9/1987 | Miller | 296/146 |
| 4,759,270 | 7/1988 | Lindeen | 98/2.14 |
| 4,890,869 | 1/1990 | Langkamp, Jr. | 292/113 |
| 5,309,972 | 5/1994 | Thomas | 160/104 X |
| 5,365,707 | 11/1994 | Jones et al. | 52/211 |
| 5,502,934 | 4/1996 | Coyne et al. | 52/200 |

*Primary Examiner*—David M. Purol
*Assistant Examiner*—Bruce A. Lev
*Attorney, Agent, or Firm*—Jo Katherine D'Ambrosio

[57] ABSTRACT

A new exterior skylight solar screen cover for engaging a skylight to prevent excessive heat build-up in a space below a skylight which has a frame, the solar screen comprising a frame member dimensioned for coupling with the exterior of the skylight. A plurality of louvers laterally extend within the frame member and a solar screen panel is dimensioned for being received within the frame member. The solar screen panel comprises a peripheral frame that is positioned on an inwardly extending lip of the upper frame section of the solar screen cover.

4 Claims, 2 Drawing Sheets

EXTERIOR SKYLIGHT SOLAR SCREEN COVER

BACKGROUND OF THE INVENTION

1. Field of the Invention

The present invention relates to skylight shading covers and more particularly pertains to a new exterior skylight solar screen cover for preventing excessive heat build-up in a space below a skylight.

2. Description of the Prior Art

The use of skylight shading covers is known in the prior art. More specifically, skylight shading covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art skylight shading covers include U.S. Pat. No. 4,328,853 to Gall et al.; U.S. Pat. No. 5,179,992 to Okarski et al.; U.S. Pat. No. 5,165,462 to Kang; U.S. Pat. No. Des. 357,071 to Jennings et al.; U.S. Pat. No. 5,204,777 to Curshod; and U.S. Pat. No. 4,398,586 to Hall.

While these devices fulfill their respective, particular objectives and requirements, the aforementioned patents do not disclose a new exterior skylight solar screen cover. The inventive device includes a frame member dimensioned for coupling with an exterior of a skylight. A plurality of louvers laterally extend within the frame member. A solar screen panel is dimensioned for being received within the frame member. A plurality of latching members are secured to a frame member for selectively engaging the frame of the skylight.

In these respects, the exterior skylight solar screen cover according to the present invention substantially departs from the conventional concepts and designs of the prior art, and in so doing provides an apparatus primarily developed for the purpose of preventing excessive heat build-up in a space below a skylight.

SUMMARY OF THE INVENTION

In view of the foregoing disadvantages inherent in the known types of skylight shading covers now present in the prior art, the present invention provides a new exterior skylight solar screen cover construction wherein the same can be utilized for preventing excessive heat build-up in a space below a skylight.

The general purpose of the present invention, which will be described subsequently in greater detail, is to provide a new exterior skylight solar screen cover apparatus and method which has many of the advantages of the skylight shading covers mentioned heretofore and many novel features that result in a new exterior skylight solar screen cover which is not anticipated, rendered obvious, suggested, or even implied by any of the prior art skylight shading covers, either alone or in any combination thereof.

To attain this, the present invention generally comprises a frame member dimensioned for coupling with an exterior of a skylight. The frame member has an upper frame section and a lower frame section. The upper frame section and the lower frame section have a plurality of support posts extending therebetween. The upper frame section and the lower frame section each have an inwardly extending lip secured around a periphery thereof. The inwardly extending lip of the lower frame section engages a frame of the skylight. A plurality of louvers laterally extend between the support posts of the frame member. The plurality of louvers are longitudinally positioned between the upper frame section and the lower frame section of the frame member. A solar screen panel is dimensioned for being received within the upper frame section of the frame member. The solar screen panel has a peripheral frame extending therearound for being positioned on the inwardly extending lip of the upper frame section. A plurality of latching members are secured to the lower frame section of the frame member for selectively engaging the frame of the skylight. The plurality of latching members are comprised of draw-up hasps secured to an exterior surface of the lower frame section. The draw-up hasps include arcuate lower members adapted for engaging the frame of the skylight. The draw-up hasps include pin clips slidably coupled therewith to preclude removal of the arcuate lower members from the frame of the skylight.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exterior skylight solar screen cover apparatus and method which has many of the advantages of the skylight shading covers mentioned heretofore and many novel features that result in a new exterior skylight solar screen cover which is not anticipated, rendered obvious, suggested, or even implied by any of the prior art skylight shading covers, either alone or in any combination thereof.

It is another object of the present invention to provide a new exterior skylight solar screen cover which may be easily and efficiently manufactured and marketed.

It is a further object of the present invention to provide a new exterior skylight solar screen cover which is of a durable and reliable construction.

An even further object of the present invention is to provide a new exterior skylight solar screen cover which is susceptible of a low cost of manufacture with regard to both materials and labor, and which accordingly is then susceptible of low prices of sale to the consuming public, thereby making such exterior skylight solar screen cover economically available to the buying public.

Still yet another object of the present invention is to provide a new exterior skylight solar screen cover which provides in the apparatuses and methods of the prior art some of the advantages thereof, while simultaneously overcoming some of the disadvantages normally associated therewith.

Still another object of the present invention is to provide a new exterior skylight solar screen cover for preventing excessive heat build-up in a space below a skylight.

Yet another object of the present invention is to provide a new exterior skylight solar screen cover which includes a frame member dimensioned for coupling with an exterior of a skylight. A plurality of louvers laterally extend within the frame member. A solar screen panel is dimensioned for being received within the frame member. A plurality of latching members are secured to a frame member for selectively engaging the frame of the skylight.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
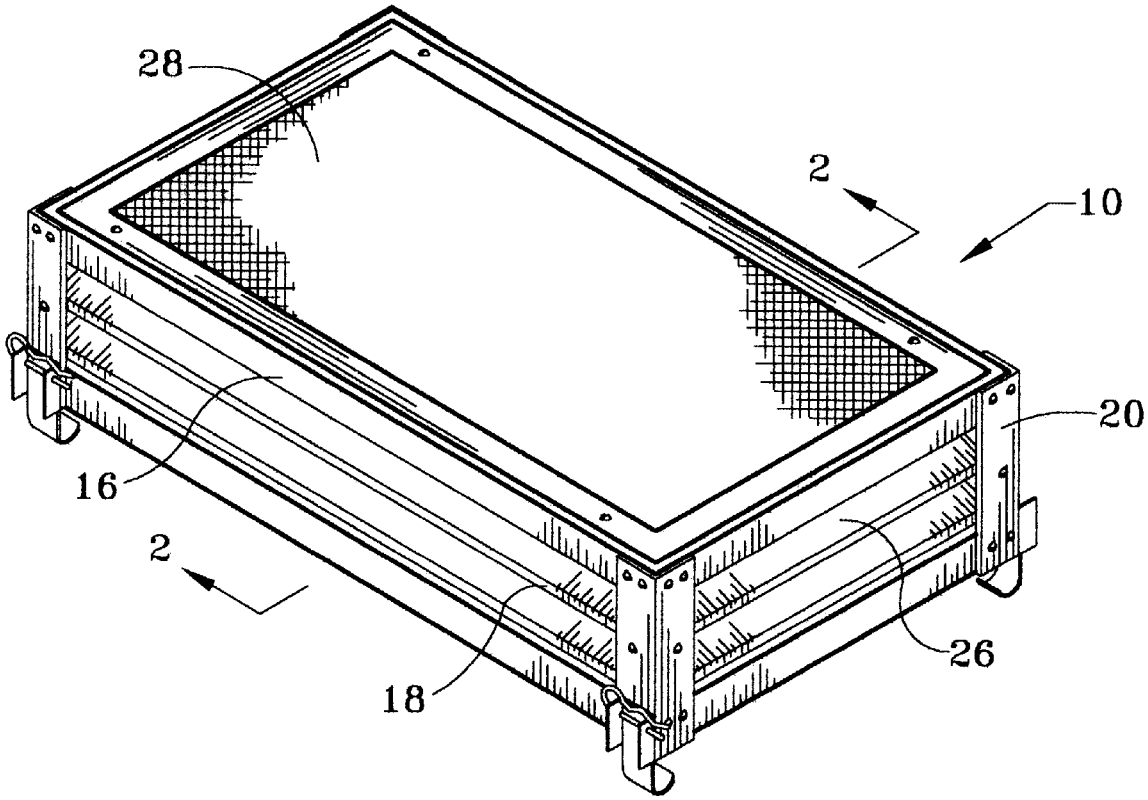
FIG. 1 is a perspective view of a new exterior skylight solar screen cover according to the present invention.
Figure 2:
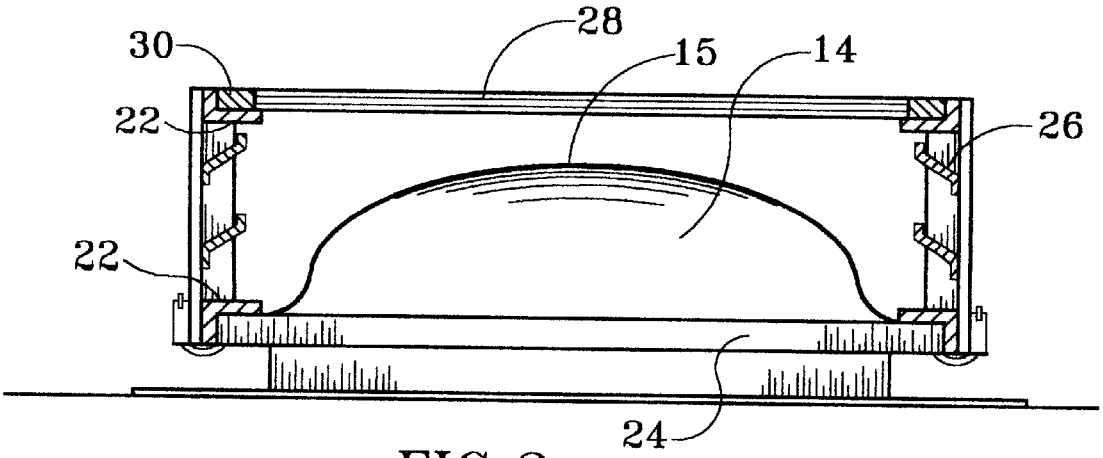
FIG. 2 is a cross-sectional view of the present invention as taken along line 2—2 of FIG. 1.
Figure 3:
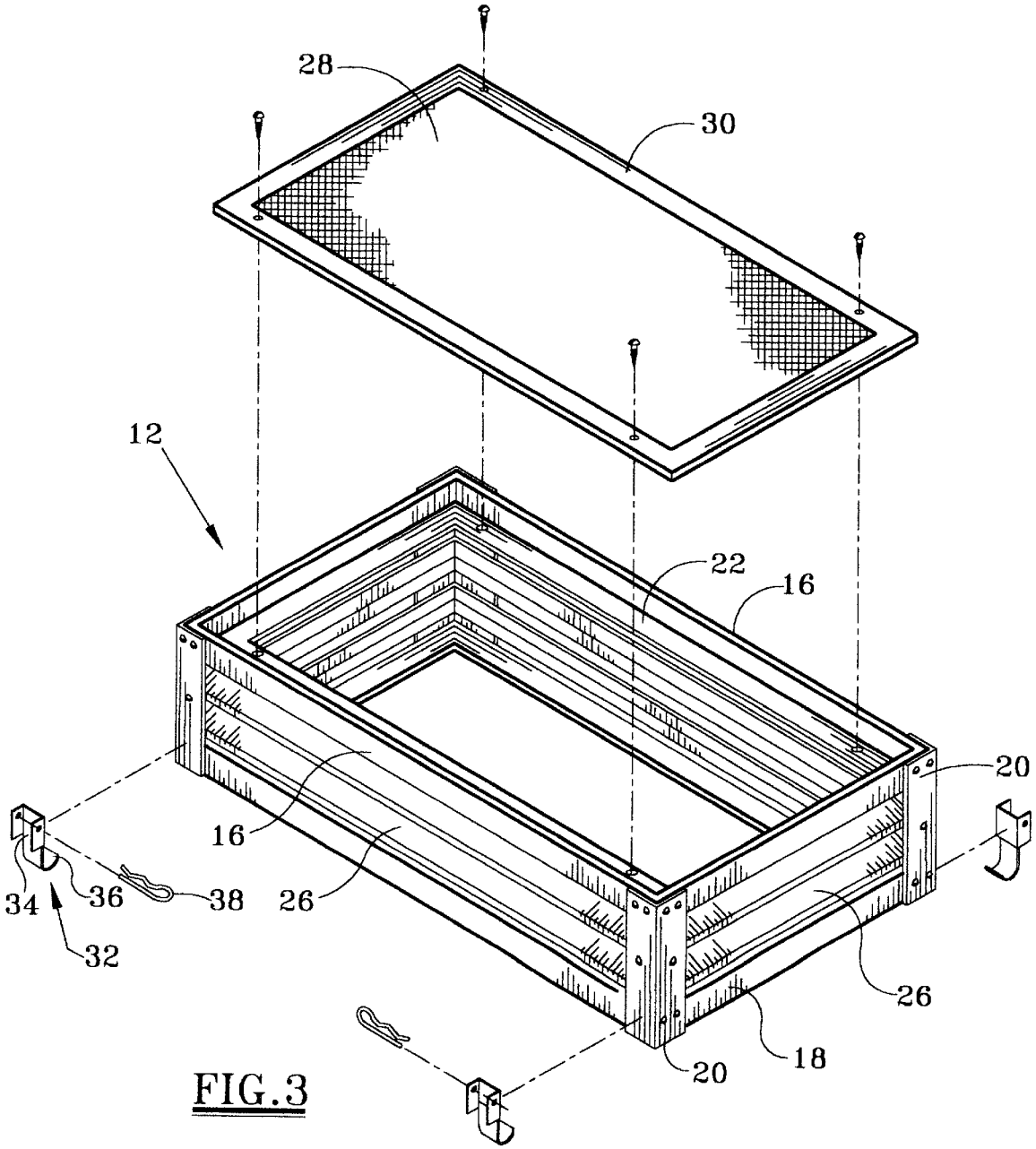
FIG. 3 is an exploded perspective view of the present invention.

With reference now to the drawings, and in particular to FIGS. 1 through 3 thereof, a new exterior skylight solar screen cover embodying the principles and concepts of the present invention and generally designated by the reference numeral 10 will be described.

As best illustrated in FIGS. 1 through 3, the exterior skylight solar screen cover 10 comprises a frame member 12 dimensioned for coupling with an exterior of a skylight 14 having a frame 24 and a dome 15. The frame member 12 has an upper frame section 16 and a lower frame section 18. The upper frame section 16 and the lower frame section 18 have a plurality of support posts 20 extending therebetween. The upper frame section 16 and the lower frame section 18 each have an inwardly extending lip 22 secured around a periphery thereof. The inwardly extending lip 22 of the lower frame section 18 engages a frame 24 of the skylight 14.

A plurality of louvers 26 laterally extend between the support posts 20 of the frame member 12. The plurality of louvers 26 are longitudinally positioned between the upper frame section 16 and the lower frame section 18 of the frame member 12. The number of louvers 26 employed will depend on the size of the frame member 12 and the size of the louvers 26 used. The louvers 26 are perpendicularly oriented with respect to the dome 15 of the skylight 14. The louvers 26 serve to block sunlight when the sun is positioned at low angles and to allow air to flow through the frame member 12 parrallel to the solar screen panel 28 to remove heat from the device 10.

The solar screen panel 28 is dimensioned for being received within the upper frame section 16 of the frame member 12. The solar screen panel 28 has a peripheral frame 30 extending therearound for being positioned on the inwardly extending lip 22 of the upper frame section 16.

A plurality of latching members 32 are secured to the lower frame section 18 of the frame member 12 for selectively engaging the frame 24 of the skylight 14. The plurality of latching members 32 are comprised of draw-up hasps 34 secured to an exterior surface of the lower frame section 18. The draw-up hasps 34 include arcuate lower members 36 adapted for engaging the frame 24 of the skylight 14. The draw-up hasps 34 include pin clips 38 slidably coupled therewith to preclude removal of the arcuate lower members 36 from the frame 24 of the skylight 14.

In use, the user would simply select the size designed to fit a particular skylight 14 that needs covering. The user would then place the screen 28 and frame member 12 over the skylight 14, and would secure it with the provided latch members 32. When properly installed, the present invention would reduce solar heating in the space below the skylight 14. The solar screen 28 would help reduce the undesirable heating in hot weather.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A solar screen cover for engaging a skylight to prevent excessive heat build-up in a space below the skylight, the skylight having a frame, an exterior and a dome, the solar screen cover comprising:

a frame member adapted for coupling engagement with the exterior of the skylight, the frame member having an upper frame section and a lower frame section, the upper frame section and the lower frame section having a plurality of support posts extending therebetween, the support posts forming sides of the solar screen cover;

a solar screen panel received within the upper frame section of the frame member, defining a solar screen panel plane which is oriented perpendicular to the sides of the solar screen cover;

a plurality of louvers positioned on the sides of the solar screen cover to laterally extend between the support posts of the frame member, the louvers further positioned between the upper frame section and the lower frame section of the frame member so that the plurality of louvers have a perpendicular orientation with respect to the screen panel plane; and one or more affixing members adapted to releasably attach the solar screen cover to the skylight.

2. The solar screen cover as set forth in claim 1 wherein the upper frame section and the lower frame section each have an inwardly extending lip secured around a periphery thereof, the inwardly extending lip of the lower frame section adapted to engage with the frame of the skylight.

3. The exterior skylight solar screen cover as set forth in claim 2 wherein the solar screen panel has a peripheral frame extending therearound for being positioned on the inwardly extending lip of the upper frame section.

4. The exterior skylight solar screen cover as set forth in claim 1 wherein one or more of fixing members are comprised of draw-up hasps secured to an exterior surface of the lower frame section, the draw-up hasps including arcuate lower members adapted for engaging the frame of the skylight, the draw-up hasps including pin clips slidably coupled therewith to preclude removal of the arcuate lower members from the frame of the skylight.

* * * * *